United States Patent [19]

Gallin

[11] 4,390,998

[45] Jul. 5, 1983

[54] PREFABRICATED CAP FRAME

[75] Inventor: Paul G. Gallin, Bronxville, N.Y.

[73] Assignee: Art Cap Company, Inc.

[21] Appl. No.: 269,227

[22] Filed: Jun. 1, 1981

[51] Int. Cl.[3] ..... A41C 5/00

[52] U.S. Cl. ..... 2/180

[58] Field of Search ..... 2/180, 175, 185, 190, 2/199

[56] References Cited

U.S. PATENT DOCUMENTS 2,848,722 8/1958 Krieger ..... 2/199

3,548,416 12/1970 Bloom et al. ..... 2/180

*Primary Examiner*—Doris L. Troutman

*Attorney, Agent, or Firm*—Curtis Ailes

[57] ABSTRACT

The cap frame is intended for use in a uniform cap of the type used by military officers, and is a unitary structure of synthetic resin including a perforated band portion with a thickened upper edge for reinforcement and an integral vertical stay portion extending from the upper edge of the band portion to support a grommet for supporting and stretching the top of the cap.

12 Claims, 11 Drawing Figures

FIG.1
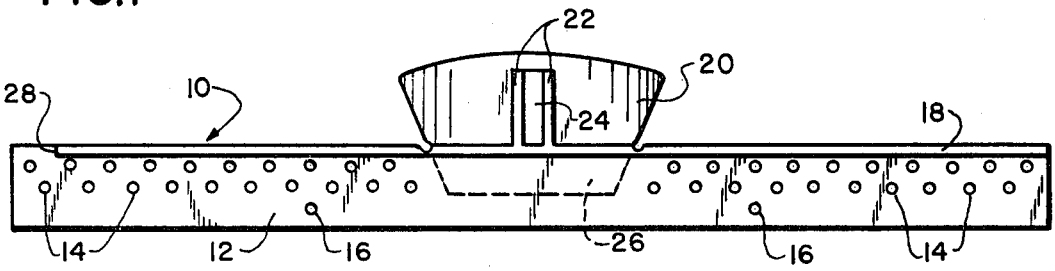
FIG.2
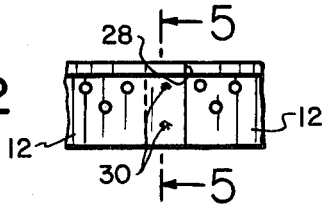
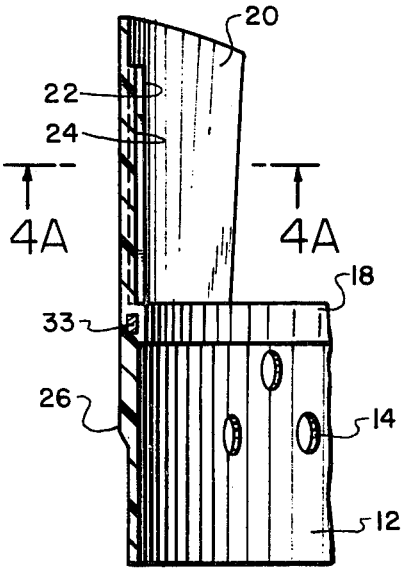
FIG.4
FIG.5
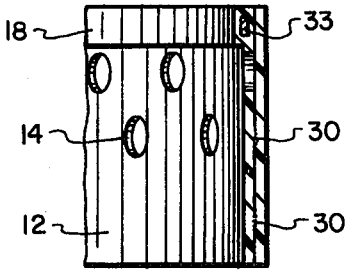
FIG.4A
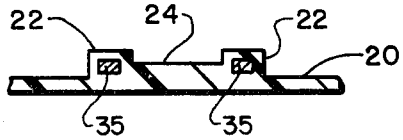
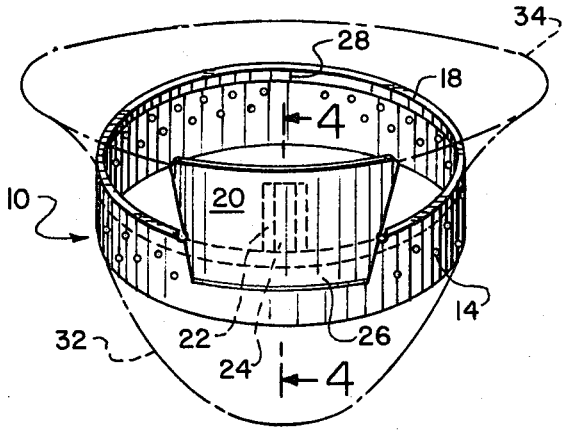
FIG.3

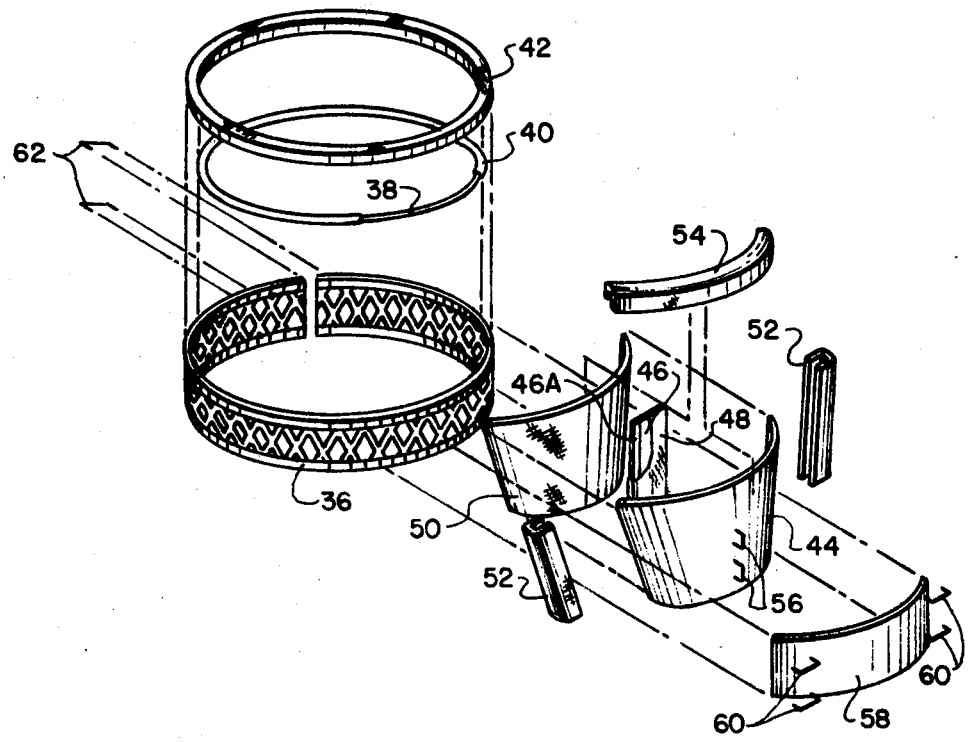
FIG.6
PRIOR ART
FIG.7
PRIOR ART
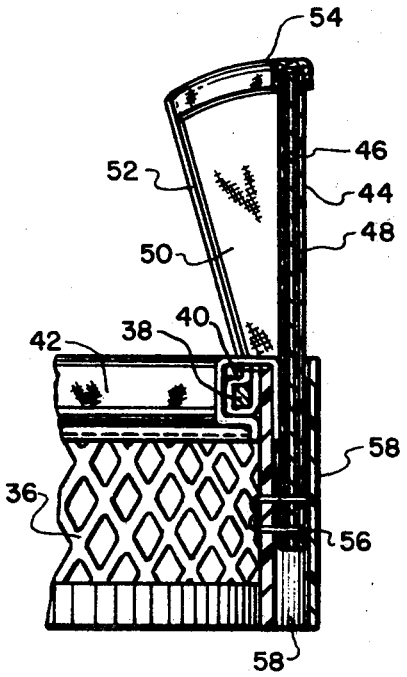
FIG.8
PRIOR ART
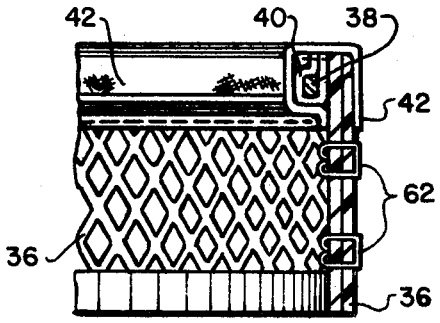

PREFABRICATED CAP FRAME

This invention relates to prefabricated cap frames which are particularly useful for uniform caps of the type worn by military personnel and peace officers.

BACKGROUND OF THE INVENTION

It is the custom for military personnel and peace officers, and others who wear uniforms, to wear a cap of the type having a visor and a grommet for supporting and stretching the top of the cap, and including a stay in front of the cap to elevate the front of the grommet and the cap at the top.

In order to provide for the desired shape of the cap together with comfort for the wearer, it has become the custom to construct a cap frame which is very elaborate, and which is built up from at least ten different parts which must be fabricated and attached together in exactly the proper relationship. Typical parts for a prior art cap frame are illustrated in an exploded view in FIG. 6 of the accompanying drawings which is described more fully below. The associated FIGS. 7 and 8 show some of the details of the assembly of the prior art cap frame. The cost of the prior art cap frame, including the cost of all of the individual parts, together with the cost of assembling those parts in exactly the right way, is very substantial. The parts must be assembled in exactly the right relative positions, and without any defects in the attachments or the assembly process in order to avoid extra costs.

Accordingly, it is an important object of the present invention to produce uniform cap frames of reduced cost.

Another object of the invention is to provide uniform cap frames of improved quality.

Another object of the invention is to provide uniform cap frames which are lighter in weight and provide greater comfort to the wearer.

Further objects and advantages will be apparent from the following description and the accompanying drawings.

SUMMARY OF THE INVENTION

In carrying out the invention there is provided a prefabricated cap frame for a uniform cap of the type having a visor and a grommet for supporting and stretching the top of the cap comprising a one piece structure molded from a flexible synthetic resin and including a perforated band portion in the form of a substantially flat open strip adapted to be curved and joined at the ends to form the hat band, said band portion including a thickened portion at the upper edge thereof for reinforcement, and an integral vertical stay portion extending from the upper edge of said band portion. Thus, a single prefabricated, unitized structure replaces an elaborate assembly of parts.

BRIEF DESCRIPTION OF THE DRAWINGS

FIG. 1 is a rear view of a prefabricated cap frame in accordance with the present invention prior to the interconnection of the ends of the band portion of the cap frame.

FIG. 2 is a detail illustrating how the ends of the band portion are joined.

FIG. 3 is a front view of the prefabricated cap frame with the ends of the band portion interconnected, and showing the other major components of the cap in phantom as they will appear when the cap is finished.

FIG. 4 is a sectional view of the cap frame taken at section 4—4 in FIG. 3.

FIG. 4A is a sectional detail taken at section 4A—4A of FIG. 4.

FIG. 5 is a sectional detail taken at section 5—5 in FIG. 2.

FIG. 6 is an exploded view of a prior art cap frame.

FIG. 7 is a sectional assembly view of the prior art cap frame of FIG. 6 and showing the portion of the cap frame corresponding to the portion of the invention illustrated in FIG. 4.

FIG. 8 is another sectional view of the prior art cap frame of FIG. 6 and illustrating the portion of the prior art cap frame corresponding to the portion of the invention illustrated in FIG. 5.

DESCRIPTION OF PREFERRED EMBODIMENT

Figure 9:
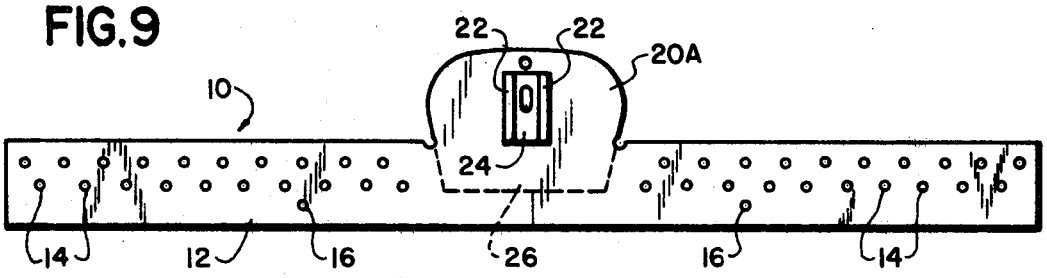
FIG. 9 is a rear view corresponding to FIG. 1 and showing an alternative embodiment of the invention.

FIG. 1 is a rear view of the prefabricated cap frame 10 in accordance with the present invention. It is preferably molded of a synthetic resin material, such as polyethelene, as one piece in an injection mold. The structure includes a band portion 12 which is preferably provided with a number of perforations 14, which may be in the form of round holes. The holes 14 provide for greater ventilation and circulation of air within the cap and thus promote comfort for the wearer. Additional holes may preferably be provided at 16 for the attachment of a threaded stud (not shown) to receive a threaded button for attachment of a cap cover to the frame at the band. The band 12 is a substantially flat open strip which is adapted to be curved and joined at the ends to form the hat band as shown and described more fully in connection with FIGS. 2 and 3.

The band portion 12 includes a thickened portion 18 at the upper edge for reinforcement of the band portion to provide for greater stiffness. Thickened portion 18 is sometimes referred to hereinafter as a "bead". The frame also includes an integral vertical stay portion 20 which extends from the upper edge of the band portion 12.

The stay portion 20 includes two vertically extending reinforcement ribs 22 integrally formed at the back surface. While only a single reinforcement rib may be provided, two are preferred, as shown. Furthermore, the material of the stay 20 is preferably thickened somewhat between the two ribs 22, as indicated at 24, to provide an even greater reinforcement of the stay. As shown in the drawing, the ribs 22 are integrally interconnected with a continuation of the thickened portion 18 of the band 12.

In order to further strengthen and reinforce the structure in the vicinity of the stay 20, the band portion 12 is reinforced by an extra thickness of material on the front of the frame in the vicinity of the stay 20, as indicated at 26. The front surface of the thickened portion 26 preferably is in the same plane as the front surface of the stay 20 so that together they form a continuous substantially flat surface. That surface is then curved when the ends of the band are joined as shown in FIG. 3.

Except for the thickened portions specifically described above, and except for the holes 14 and 16, the entire structure of the cap frame preferably has a relatively uniform thickness.

The thickened portion, or bead, 18 along the upper edge of the band portion 12 is preferably interrupted for about 1 inch at the left end of the band, as indicated at 28. This interruption of the thickening or bead 18 can be molded in, or the bead can be ground off after the length of the band has been determined for the size of the frame required. The ends of the band portion 12 can be cut to provide any desired size before joining the ends. The band is initially made long enough to provide the largest size desired.

FIG. 2 shows how the respective ends of the band portion 12 can be attached together by simply overlapping the right end, shown at the left in FIG. 2 with the left end, shown at the right in FIG. 2, so that the right end of the bead 18 butts up against the interrupted end 28 of the bead on the left end. The overlapped ends of the hat band portion 12 are then heat welded together, as schematically indicated at 30. While heat welding is preferred, the overlapped ends can be joined by metal staples, or by sewing.

The view of FIG. 1 was characterized as a rear view of the prefabricated cap frame. This may also be characterized as an inside view of the stay portion 20, as well as the band portion 12. The ends of the band portion 12 are joined in such a manner as to place the surfaces visible in this so-called rear view of FIG. 1 on the inside of the cap frame. With this manner of interconnection, the bead or thickening 18 is preferably entirely facing inward on the cap frame, as will be more apparent from FIGS. 4 and 5.

FIG. 3 is a perspective view of the cap frame of the invention with the ends of the band portion interconnected, and illustrating in phantom the positions of the other major outlines of the cap which is to be built around the frame. The other components include the visor indicated at 32, and the top rim of the cap 34, as it will be stretched out by a grommet, which will be attached to the top edge of the stay 20.

FIG. 4 is a sectional detail view taken at section 4—4 of FIG. 3, and drawn to a larger scale. FIG. 4 illustrates in considerable detail the features described above in connection with FIG. 1, and particularly in relation to the stay 20. The components are all numbered to correspond to the numbering of FIG. 1, and are believed to be easily identified in FIG. 4. As illustrated particularly in FIG. 4, the bead or thickened portion 18 which reinforces the upper edge of the band portion 12 protrudes exclusively at the inside surface of the band 12. The bead or thickened portion 18 may include a metal wire 33 embeded therein for additional stiffening and support of the hat band 12.

FIG. 4A is a sectional detail taken at section 4A—4A in FIG. 4. FIG. 4A more clearly shows the structure of the reinforcement ribs 22 and the thickened portion 24. As indicated in FIG. 4A, metal wires 35 may be embeded within the ribs 22 to provide for additional stiffening of the ribs and the stay. The wires 35 may preferably extend down below the bead 18, and the wires 35 may be joined, and be integral with, the reinforcement wire 33 within the bead 18.

FIG. 5 is a sectional detail view drawn to the same scale as FIG. 4, and taken at section 5—5 of FIG. 2. FIG. 5 further illustrates the structure of the overlap joint between the two ends of the band portion 12, including the heat welds 30.

FIGS. 6, 7, and 8 illustrate a typical prior art cap frame which the cap frame of the present invention replaces.

FIG. 6 is an exploded view of the prior art cap frame, and of the parts which are replaced by the prefabricated unitary cap frame of the present invention. Those parts include a band 36, a reinforcement wire 38 for the upper edge of the band, a fabric cover 40 for the reinforcement wire 38 by means of which the reinforcement wire 38 is fastened to the upper edge of the band 36 by sewing, and a fabric cover 42 which is attached to the upper edge of the band 36 around the reinforcement wire 30 and the cover 40. The structure also includes a stay consisting of a resin face plate 44, a brace 46 for the stay which includes a fabric cover 48, and a fabric back piece 50 for the stay. The brace 46 consists of two wires 46A arranged vertically in parallel at the outer edges of the brace 46, and joined by a fiber interconnector. The stay also includes side edge bindings 52, and a top edge binding 54 for binding and joining the edges of the face plate 44 and the fabric back piece 50 to thus enclose the brace 46. The stay sub-assembly, consisting of the parts 44 through 54, is secured to the band 36 by a number of metal staples, only two of which are illustrated at 56. A face plate 58 composed of a synthetic resin is attached to the band 36 by staples 60 to cover the staples 56 and the bottom edge of the stay face plate 44, and to provide a smooth contour for the front outside surface at the band. The ends of the band 36 may preferably be attached together by means of metal staples indicated at 62.

Thus, it is seen from the exploded view of FIG. 6, that more than 13 separate parts must be fabricated and assembled to produce a conventional cap frame which is replaced in the present invention by a single part.

FIG. 7 is a vertical sectional detail taken through the center line of the assembled prior art structure illustrated in FIG. 6, and generally corresponding to the sectional view of FIG. 4 illustrating the invention.

FIG. 8 is a sectional detail taken at a vertical section of the band 36 and the parts 38, 40, and 42 of the prior art structure of FIG. 6 at the overlap joint between the ends of band 36, and generally corresponding to FIG. 5 illustrating the invention.

Since the parts illustrated in FIGS. 7 and 8 are numbered to exactly correspond to the parts previously described in FIG. 6, the details of construction should be obvious from the prior description of FIG. 6. The side edge bindings 52 have been omitted in FIG. 7 in order to promote clarity.

Figure 10:
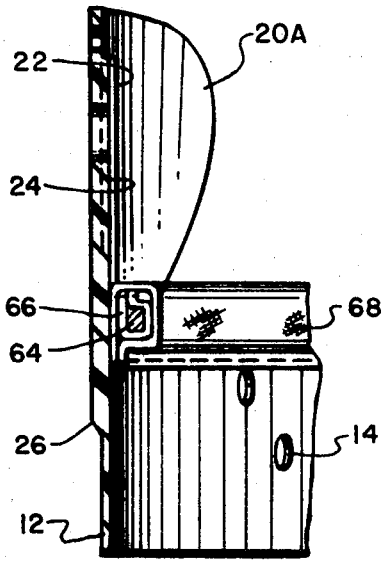
FIG. 10 is a sectional detail view taken at section 10—10 in FIG. 9.
Figure 11:
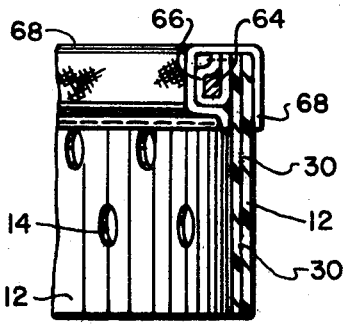
FIG. 11 is a sectional detail taken at section 11—11 of FIG. 9.

FIG. 9 is a back view corresponding to FIG. 1 and showing an alternative embodiment of the invention in which the stay 20 is somewhat reduced and revised in shape as shown at 20A. Also, as an alternative feature, the bead or thickening 18 at the top of the band 12 has been omitted from the band in FIG. 9. In the embodiment of FIG. 9, as an optional feature, a reinforcement wire 64 with a fabric cover 66 may be attached by sewing at the top edge of the band 12 to provide the function of reinforcing the band. However, the reinforcement wire 64 and the fabric cover 66 are not illustrated in FIG. 9, but are shown instead in the sectional views of FIGS. 10 and 11, which are sections taken respectively at 10—10 and 11—11 of FIG. 9. Preferably also an outer fabric cover 68 is provided over the reinforcement wire 64 and cover 66, as shown in FIGS. 10 and 11.

The two features of the stay 20A of the different shape illustrated in FIG. 9, and the substitution of the reinforcement wire 66 and fabric cover 68 for the bead 18 in FIG. 9 do not necessarily have to go together. Thus, the stay shape 20A of FIG. 9 can be used with the prefabricated cap frame structure previously described in connection with FIGS. 1 through 5, and the stay shape 20 illustrated in FIG. 1 can be employed with the alternative reinforcement wire 66 and cover 68 in the structure of FIGS. 9, 10, and 11.

It will be apparent from the above description that the invention, particularly in the preferred embodiment illustrated in FIGS. 1 through 5, achieves all of the objects set forth at the beginning of the specification, including reducing the cost of cap frames, providing cap frames of improved quality, providing cap frames which are lighter in weight, and which provide greater comfort. It has also been found that the cap frames of the invention promote cleanliness since the structure is simpler and does not include so much fabric or so many crevices which can harbor and hold perspiration, and hair oil, and soil which enters and is held by the perspiration and hair oil.

While this invention has been shown and described in connection with a particular preferred embodiment, it is apparent that various changes and modifications, in addition to those mentioned above, may be made by those who are skilled in the art without departing from the basic features of the invention. Accordingly, it is the intention of the applicant to protect all variations and modifications within the true spirit and valid scope of this invention.

I claim:

1. A prefabricated cap frame for a uniform cap of the type having a visor and a grommet for supporting and stretching the top of the cap comprising a one piece structure molded from a flexible synthetic resin and including a perforated band portion in the form of a substantially flat open strip adapted to be curved and joined at the ends to form the hat band, said band portion including a thickened portion at the upper edge thereof for reinforcement, and an integral vertical stay portion extending from the upper edge of said band portion.

2. A structure as claimed in claim 1 wherein said thickened portion at the upper edge of said band portion protrudes exclusively at the inside surface of said band portion.

3. A structure as claimed in claim 2 wherein said vertical stay portion includes at least one vertically extending reinforcement rib integrally formed at the inner surface thereof.

4. A structure as claimed in claim 3 wherein two vertically extending reinforcement ribs are provided and are positioned equidistant on opposite sides of the center line of said vertical stay portion.

5. A structure as claimed in claim 4 wherein said vertical stay portion is additionally provided with a thickened region extending between said vertically extending reinforcement ribs.

6. A structure as claimed in claim 3 wherein said band portion includes a thickened portion in the region directly adjacent to said integral vertical stay portion.

7. A structure as claimed in claim 6 wherein the entire structure is composed of material having a relatively uniform thickness except for the reinforcement ribs and thickened portions specifically recited.

8. A structure as claimed in any one of the preceding claims which consists essentially of polyethylene.

9. A uniform cap combination comprising a visor and a soft suiting material top with a grommet for supporting and stretching the top of the cap, and including a one piece synthetic resin prefabricated cap frame combination including a band and stay for supporting the grommet in an elevated position, said combination band and stay structure including a perforated band portion in the form of a substantially flat open strip which is curved and joined at the ends to form the hat band and which includes a thickened portion at the upper edge thereof for reinforcement, and said combined structure including an integral vertical stay portion extending from the upper edge of said band portion.

10. A structure as claimed in claim 2 wherein said thickened portion at the upper edge of said band portion includes a metal wire reinforcement embeded therein.

11. A structure as claimed in claim 3 wherein a metal wire reinforcement is embeded within each of said reinforcement ribs.

12. A prefabricated cap frame for a uniform cap of the type having a visor and a grommet for supporting and stretching the top of the cap comprising a structure molded from a flexible synthetic resin and including a perforated band portion in the form of a substantially flat open strip adapted to be curved and joined at the ends to form the hat band, an integral vertical stay portion extending from the upper edge of said band portion, and a reinforcement attached at the upper edge of said band portion and extending for the full length thereof, said reinforcement comprising a metal wire enclosed within a fabric cover and attached by sewing the fabric cover to the upper edge of said band portion.

* * * * *